US005350229A

United States Patent [19]

Smed

[11] Patent Number: 5,350,229

[45] Date of Patent: Sep. 27, 1994

[54] SECURE STORAGE DESK DRAWER AND INSTALLATION CLAMP THEREFOR

[75] Inventor: Ole Smed, 655 Wilderness Drive S.E., Calgary, Alberta, Canada, T2J 1Z5

[73] Assignee: Ole Smed, Calgary, Canada

[21] Appl. No.: 977,006

[22] Filed: Nov. 16, 1992

[51] Int. Cl.[5] ..... A47B 88/04

[52] U.S. Cl. ..... 312/334.23; 312/333; 312/348.3

[58] Field of Search ..... 312/330.1, 333, 334.23, 312/334.7, 348.3, 348.4, 334.26; 70/85, 86; 108/26

[56] References Cited

U.S. PATENT DOCUMENTS

| | | | |
|---|---|---|---|
| 1,838,558 | 12/1931 | Kolodny | 312/348.3 |
| 2,242,903 | 5/1941 | Crimmel | 108/26 |
| 2,257,741 | 10/1941 | Gray | 70/85 |
| 3,260,491 | 7/1966 | Goode | 248/345.1 |
| 3,649,095 | 3/1972 | Gunzburg | 312/333 |
| 4,475,778 | 10/1984 | Stark | 312/334.26 X |
| 4,595,246 | 6/1986 | Bross | 312/348.3 |
| 5,013,106 | 5/1991 | Twellmann | 312/330.1 |

FOREIGN PATENT DOCUMENTS

| | | | |
|---|---|---|---|
| 2751155 | 5/1979 | Fed. Rep. of Germany | 312/348.3 |
| 652579 | 11/1985 | Switzerland | 312/334.26 |

*Primary Examiner*—Brian K. Green

*Attorney, Agent, or Firm*—Oblon, Spivak, McClelland, Maier & Neustadt

[57] ABSTRACT

A secure storage drawer and an installation clamp for the drawer are disclosed. The drawer is suitable for mounting to a horizontal surface without surrounding cabinetry. Suspension rails which support the slides for the drawer are so designed that when the drawer is closed there are no exposed fasteners. Tampering is thus discouraged. The drawer has a wide preferably partitioned front storage area and a wide deep rear storage area which is large enough to accommodate purses or handbags. The drawer is readily retrofitted to installed furniture. An advantage of the drawer is that it provides generous storage capacity yet permits a seated user to move freely across a front of a desk or table to which the drawer is mounted. The installation clamp permits a drawer to be retrofitted to installed furniture quickly and efficiently. The installation clamp is useful for mounting any drawer supported by suspension brackets.

8 Claims, 5 Drawing Sheets

SECURE STORAGE DESK DRAWER AND INSTALLATION CLAMP THEREFOR

FIELD OF THE INVENTION

The present invention relates to furniture systems and, in particular, to a secure storage drawer which is particularly adapted for use with modern furniture constructions. The invention further relates to an installation clamp which is expressly adapted to retrofitting furniture with drawers mounted in accordance with the invention.

BACKGROUND OF THE INVENTION

Modern office work surfaces frequently comprise thin flat panels supported at working height by two or more legs. Although such constructions are attractive and economical to produce, they frequently offer little or no storage space. In order to satisfy the requirement for storage space, it is common practice to supply an auxiliary cabinet of drawers which is generally mounted on wheels or casters. Although auxiliary units provide drawer space, they also occupy floor space and inhibit freedom of movement if placed under the work area. Another common problem with modern office storage space is that drawers are either not secure or lack capacity. Office workers are therefore frequently without a secure place for storing purses, handbags or other bulky items preferably not left in accessible places.

There therefore exists a need for a secure drawer having a generous storage capacity. Providing a secure drawer which is harmonious with modern office furniture design is a difficult task. Ideally, such a drawer should not interfere with movement along a front edge of a work desk or table, should be capable of being locked upon being closed and should be capable of being readily retrofitted to practically any panel construction.

Retrofitting office furniture with storage drawers can be a tedious and time consuming task. Those skilled in the art are aware of the inherent difficulties in retrofitting drawers to furniture units. Drawers are traditionally installed in stand alone units which may be plumed, squared, and reinforced as necessary. In order to provide a drawer which may be retrofitted to furniture, it is necessary to design a drawer which will operate smoothly and reliably in an environment in which it is installed. A further problem is that work areas are often cluttered with work related materials and are not necessarily readily disencumbered so that they may be displaced for the installation of a drawer.

It is therefore desirable to provide a drawer installation clamp which permits panel furniture constructions to be retrofitted with drawers mounted in accordance with the invention.

SUMMARY OF THE INVENTION

It is an object of the invention to provide a storage drawer for a desk or the like which requires no surrounding cabinetry.

It is a further object of the invention to provide a storage drawer for a desk or the like which provides secure storage without surrounding cabinetry.

It is yet a further object of the invention to provide a storage drawer for a desk or the like which permits substantially free movement by a seated user along a front of the desk while providing a capacity at a rear of the drawer for storing large items such as purses and the like.

It is yet another object of the invention to provide an installation clamp useful for retrofitting installed furniture with drawers which do not require surrounding cabinetry.

In accordance with the invention there is therefore provided, a storage drawer, preferably securable for mounting to a horizontal support surface comprising: a pair of suspension brackets for mounting in a parallel relationship to support the storage drawer, each suspension bracket including a U-shaped channel with a bottom wall and parallel sidewalls for slidably supporting a drawer slide, one of the channel sidewalls being longer than another of the sidewalls, the longer sidewall being inturned so that a portion thereof forms a flat flange in a plane above the shorter sidewall and parallel with the bottom wall of the channel and a free edge of the flange extends past a plane coincident with the shorter sidewall, the free edge being adapted for receiving fasteners for mounting the suspension bracket to the support surface;

the storage drawer including a rectangular drawer face, a shallow storage area extending rearwardly of the drawer face, and a deep storage area extending rearwardly of the shallow storage area, the drawer being slidably supported by the drawer slides which reciprocate in the U-shaped channel, and the drawer being of a length such that the drawer conceals each of the fasteners for mounting the suspension brackets when the drawer is in a closed condition and once installed, the drawer permits complete freedom of movement for a user of the horizontal support surface along its front edge; and, preferably means for locking the drawer in a closed condition so that access to the drawer and the fasteners for mounting the suspension brackets may be effectively controlled.

In accordance with a further aspect of the invention there is provided an installation clamp for mounting the drawer to an underside of a panel having parallel top and bottom surfaces, comprising: a pair of side frames for supporting suspension brackets which house slides for the drawer, each said side frame having an elongated U-shape with parallel spaced-apart legs that define a bite for receiving an edge of the panel; a cross-tie for fixedly interconnecting an end of one leg of each U-shaped side frame so that the side frames are in spaced-apart, parallel, mirror image relationship; an L-shaped support bracket affixed to an inner side of each of the legs opposite the cross-tie, the L-shaped support brackets being adapted to receive and support the suspension brackets for the drawer, the side frames being spaced-apart by the cross-tie so that the support brackets receive and support the drawer with the drawer slides and the suspension brackets attached; and, means associated with at least a one of the cross-tie and side frame ends connected by the cross-tie for applying clamping pressure to the top surface of the panel, whereby the drawer assembly is positioned on the support brackets and the installation clamp is attached to an edge of the panel in a position where the drawer is to be mounted and the means for applying clamping pressure to the top surface of the panel are manipulated to clamp the drawer against the panel by applying pressure the suspension brackets, the drawer thereafter being slid outwardly to an end of its travel to permit access to the suspension brackets so that fasteners can be driven to attach the drawer to the panel.

BRIEF DESCRIPTION OF THE DRAWINGS

The invention will now be explained by way of example only and with reference to the following drawings, wherein.

DETAILED DESCRIPTION OF A PREFERRED EMBODIMENT

Figure 1:
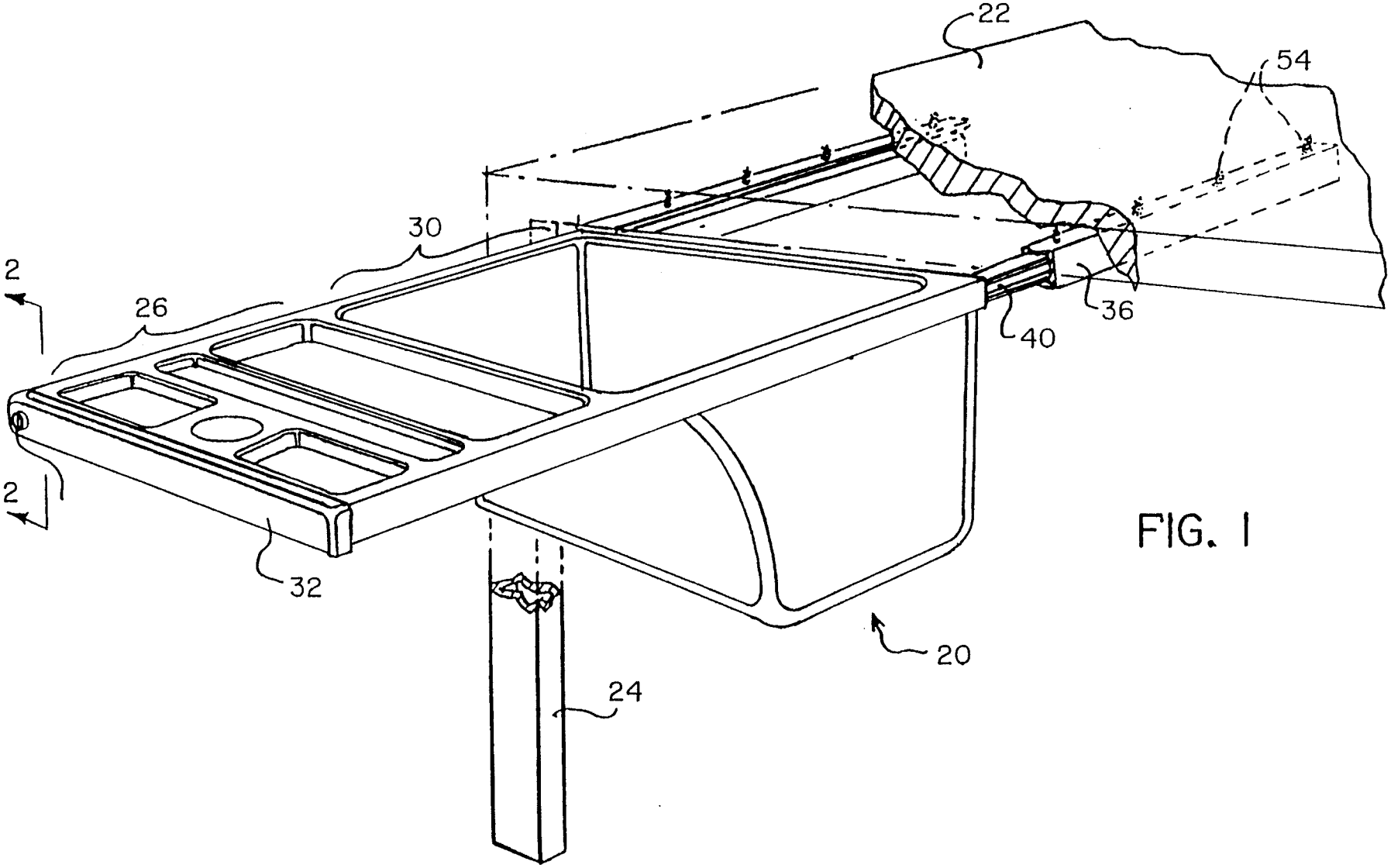
FIG. 1 is a perspective view of a drawer in accordance with the invention in an opened condition, the drawer being mounted to a desk shown in a partially cut-away perspective view.

FIG. 1 shows a perspective view of a secure storage drawer, generally indicated by reference 20, in accordance with the invention. The storage drawer 20 is designed to be mounted to a horizontal surface without surrounding cabinetry. As shown in FIG. 1, the storage drawer 20 is mounted to one example of a modern desk construction which comprises a composite panel 22 supported on legs 24.

In accordance with the preferred embodiment of the storage drawer 20 shown in FIG. 1, the drawer has a shallow storage area of some depth in the front and a deep storage area in the rear. The shallow storage area, generally indicated by the reference 26, is preferably partitioned into a plurality of molded compartments which are useful for storing pencils, erasers, paper clips, scissors, pens, and other paraphernalia useful at an office work area. The depth of the shallow area is also selected to ensure that knee clearance is provided for the desk or work surface user once the drawer is installed. The deep storage bin, indicated by reference 30, at the rear of the drawer is useful for providing secure storage for items such as purses, handbags and/or file folders and the like. The drawer is preferably wide enough to accommodate a legal sized file folder and will accommodate file folder hangers, if desired. This novel drawer construction permits the drawer to be mounted to the underside of a desk without interfering with the substantially free movement of a user at the desk since the deep storage area 30 is recessed from the front of the desk when the drawer is in a closed condition. The drawer 20 is preferably constructed from heat molded high-impact polystyrene although other sturdy thermoset or thermoplastic materials may also be used.

In order to provide protection against damage to chair arms and clothing, the drawer front is preferably covered with a soft, durable drawer front cover 32 which is preferably cold-molded from flexible polyurethane in a manner well known in the art. In order provide security, the drawer must be lockable. This is preferably accommodated by a key lock 34, shown on a front left corner of the drawer front cover 32. The construction and operation of the key lock 34 will be explained in more detail with reference to FIG. 2. The storage drawer 20 is slidably mounted to suspension brackets 36 which accommodate drawer slides 40, preferably ball-bearing slides for ease of operation. In order to ensure the security of the storage provided by the storage drawer 20, the suspension brackets 36 are specially constructed in a manner which will be explained in detail with reference to FIG. 3.

Figure 2:
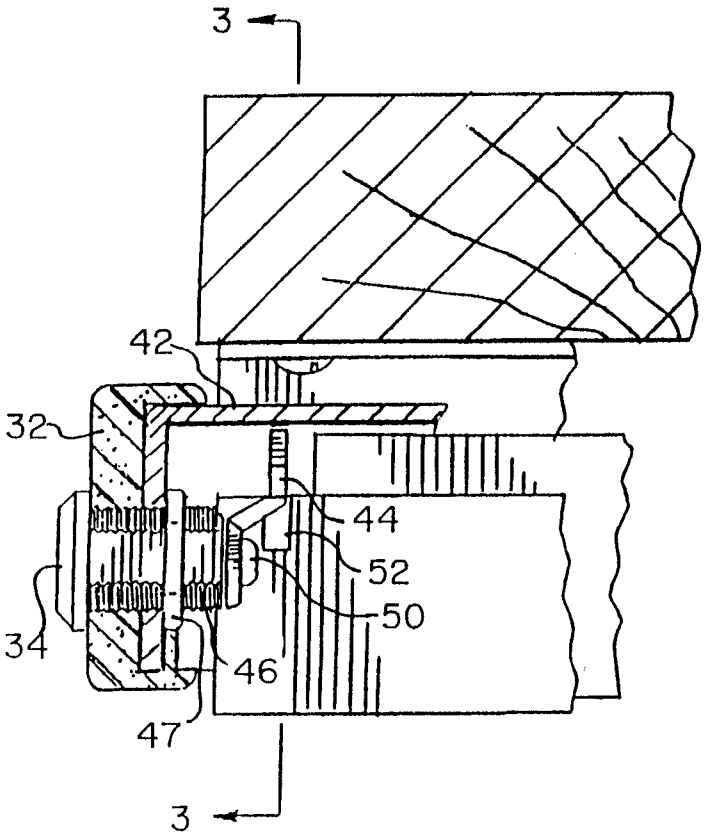
FIG. 2 is a cross-sectional view of the drawer front taken along lines 2—2 of FIG. 1.

FIG. 2 shows a cross-sectional view of the drawer front 32 taken along lines 2—2 of the FIG. 1. The key lock 24 is mounted in a threaded bore which pierces a metal core 42 for the drawer front cover 32. The metal core 42 provides a secure mounting for the key lock 34. The metal core 42 is attached to a front of the molded drawer 20 using screw fasteners (not illustrated), rivets or other suitable fasteners well known in the art. In order to prevent tampering with the key lock 34, the metal core 42 preferably overhangs a top of the drawer front by at least enough to cover a lock arm 44. Rotation of barrel 46 of the key lock is inhibited by a lock nut 47 which abuts the metal core 42. The lock arm 44 is secured to the barrel 46 by a screw fastener 50. This permits the barrel 46 to be changed if required due to mechanical failure or loss of a key. The lock arm 44 engages a notch 52 in a suspension bracket 36 to lock the drawer in a closed condition.

Figure 3:
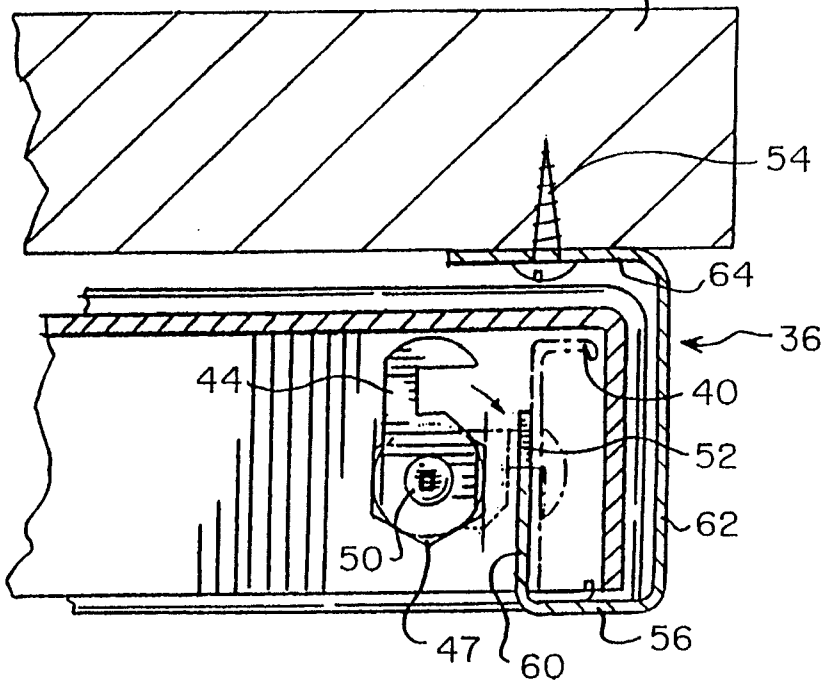
FIG. 3 is a cross-sectional view of the drawer front taken along lines 3—3 of FIG. 2.

FIG. 3 shows a cross-sectional view taken along lines 3—3 of FIG. 2. As shown in the illustration, the lock arm 44 is rotated from an unlocked position (shown in solid lines) to a locked position (shown in dotted lines) wherein the lock arm 44 engages the slot 52 in the suspension bracket 36.

As noted above, in order to provide a secure storage drawer, it is necessary to provide a mounting system which cannot be tampered with when a drawer is in a locked condition so that access to the drawer by removing the drawer from its mounting is prevented. To preclude such tampering, the suspension rails 36 are constructed in a manner that the fasteners which affix the drawer to the panel 22 are inaccessible when the storage drawer 20 is in a closed condition. As is readily apparent in cross-sectional view, the suspension bracket 36 includes a U-shaped channel for supporting a drawer slide 40. The U-shaped channel has a bottom wall 56 and opposed sidewalls 60 and 62. The sidewall 62 is considerably longer than the sidewall 60 and is inturned so that a portion of the sidewall 62 forms a flat flange 64 in a plane above the shorter sidewall and parallel with the bottom wall 56 of the U-shaped channel. A free edge of the flange 64 extends past the shorter sidewall 60 and is adapted to receive fasteners for mounting the suspension bracket 36 to the panel 22. In accordance with the preferred embodiment, the flange 54 is pierced at regular intervals with bores to accommodate screw fasteners 54 which are driven into the panel 22 to attach the suspension brackets 36 to the panel. The drawer 20 (see FIG. 1) is preferably of a length which matches the length of suspension bracket 36 so that in a closed condition each of the screw fasteners 54 is inaccessible and tampering with the drawer mounting is effectively prohibited.

Figure 4:
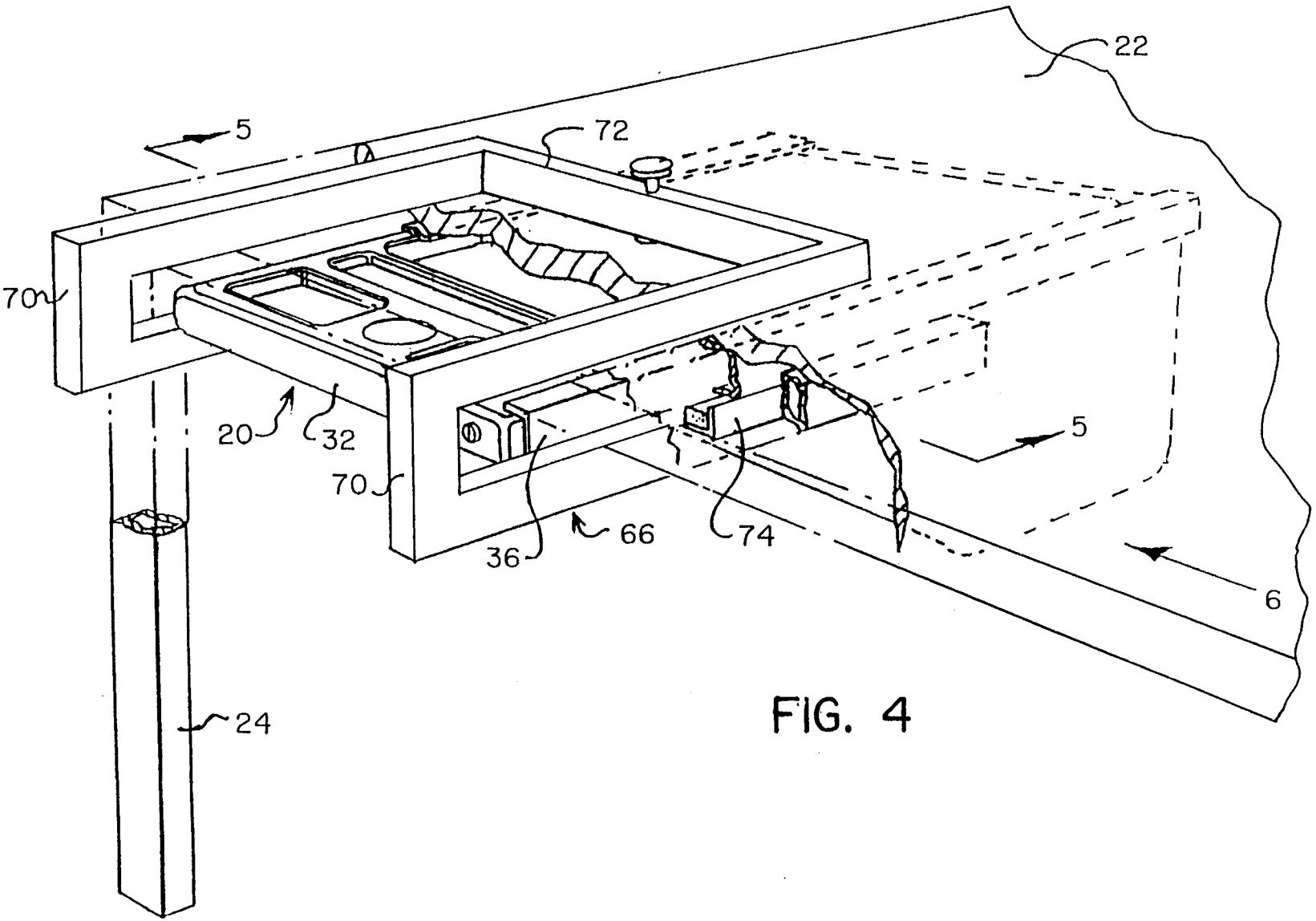
FIG. 4 is a partially cut-away perspective view of the drawer shown in FIG. 1, the drawer being mounted to a furniture panel using an installation bracket in accordance with a further aspect of the invention.

It will be appreciated by those skilled in the art that the drawer construction in accordance with the invention is most readily and efficiently installed using an installation clamp. This is especially true when the drawer is being retrofitted to a desk or the like. In accordance with a further aspect of the invention there is therefore provided an installation clamp generally referred to by the reference 66, as shown in FIG. 4. The installation clamp includes a pair of side frames 70. Each side frame 70 has an elongated U-shape. The side frames are interconnected by a cross-tie 72 which fixedly interconnects ends of top legs of the U-shaped side frames 70 so that the side frames are in a spaced-apart, parallel, mirror image relationship. Attached to an inner side of each of the legs opposite the cross-tie is an L-shaped support bracket 74 for receiving and supporting the suspension bracket 36. The sides of the bracket 74 are preferably padded at 74*a*, with cork or a similar material to prevent damage to the drawer during installation. Padding is also provided at 70*a* on the inner sides of legs 70 for the same purpose. In order to install a storage drawer 20 in accordance with the invention, the entire drawer, including the suspension brackets 36 and the drawer slides 40, is positioned on the installation clamp 66 and a bight formed by the upper and lower legs of the U-shaped side frames 70 is slid over a front edge of the panel 22.

Figure 5:
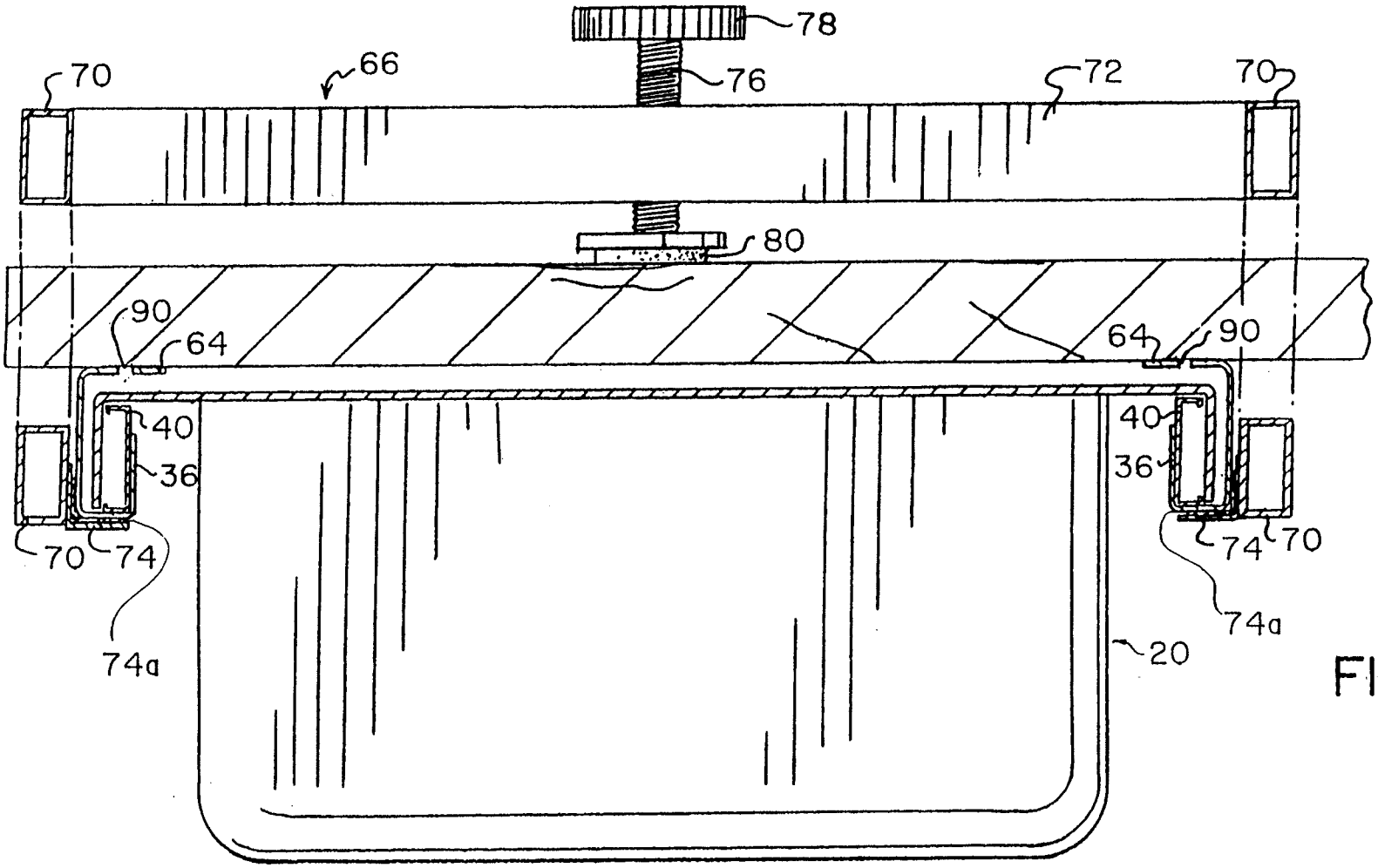
FIG. 5 is a cross-sectional view taken along lines 5—5 FIG. 4.

FIG. 5 shows a cross-sectional view of the drawer and installation clamp assembly taken along lines 5—5 of FIG. 4. After the installation clamp 66 is positioned on the panel 22 so that the drawer front 32 (see FIG. 4) is flush with a front edge of the panel 22, a clamp screw 76, having a knurled knob 78 on its top end and a padded foot 80 on its bottom end, is screwed downwardly to apply pressure on a top surface of the panel 22. The pressure applied on the top surface of panel 22 lifts the suspension brackets 36 into contact with an underside of the panel 22. Once the suspension rails 36 contact the underside of the panel 22 the drawer front is adjusted to ensure that it is flush with a front edge of the panel 22. The clamp screw 76 is then further tensioned and the action of the drawer is tested by sliding the drawer inwardly and outwardly. As is apparent from an inspection of FIGS. 4 and 5, the drawer action may be tested with the installation clamp in place. If the storage drawer 20 does not operate smoothly, the clamp screw 76 is loosened, adjustments to the position of the suspension rails 36 are made, and the clamp 76 is again tensioned until the suspension rails 36 are held in secure contact with the underside of the panel 22. When the drawer operates smoothly, the drawer is moved to its fully extended position and screw fasteners 54 (see FIGS. 1 and 3) are driven through bores 90 in the flange 64 of suspension bracket 36.

Figure 6:
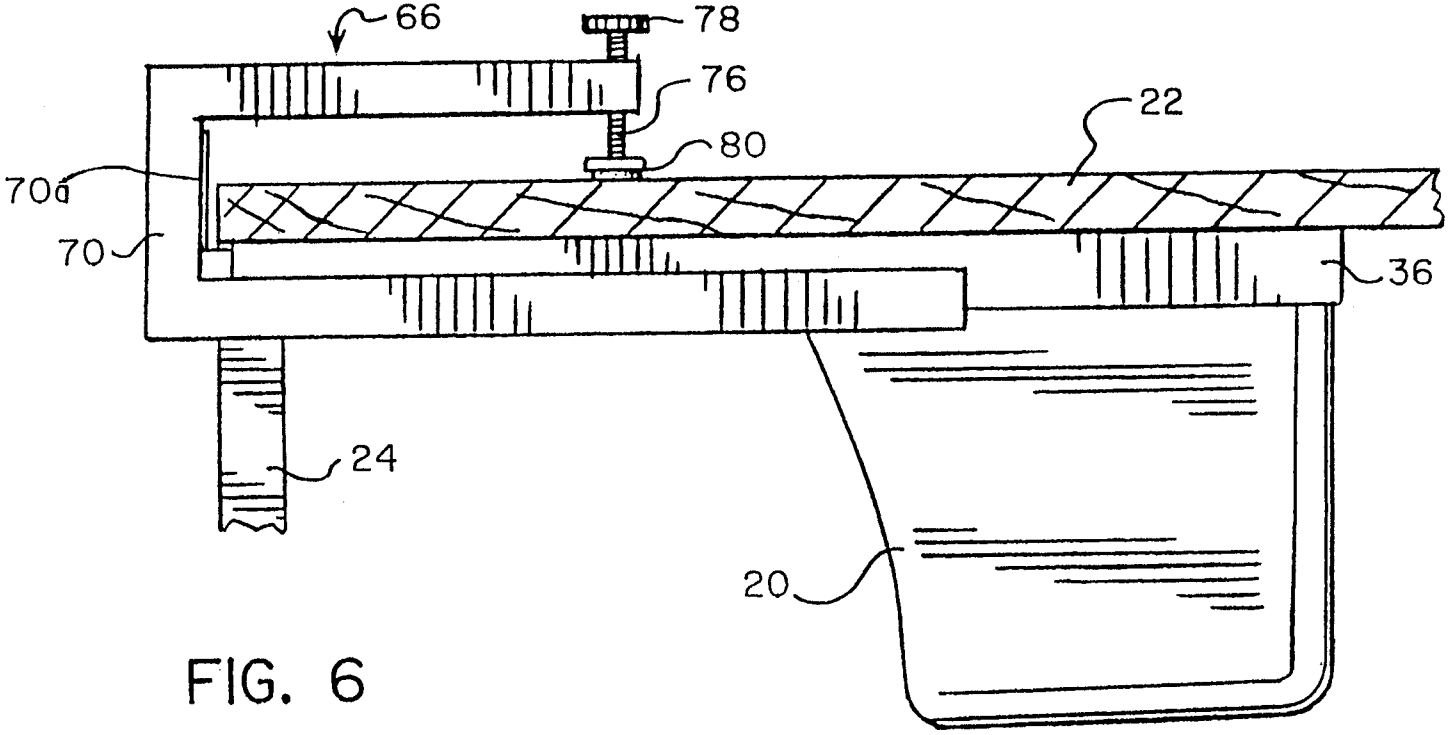
FIG. 6 is a side elevational view of the drawer and installation bracket shown in FIG. 4.

FIG. 6 shows a side elevational view of the installed storage drawer 20 with the installation bracket 66 still in a clamped position. The storage drawer 20 shown in FIG. 6 is in a closed position the screw fasteners having been driven through holes 90 in the suspension rails 36 (see FIG. 5). As is apparent, the storage drawer 20 extends rearwardly to an end of the suspension rails 36 so that screw fasteners 54 (see FIG. 1) are inaccessible when the storage drawer 20 in the closed position. As noted above, this prevents tampering with the storage drawer when the drawer is locked. After installation of the storage drawer 20 is complete, the clamp screw 76 is loosened and the installation clamp 66 is removed by sliding the bite formed by the side frames 70 off of the panel 22. This arrangement permits the drawer to be retrofitted to installed furniture without disturbing the furniture with the exception of clearing an area adjacent the front edge to accommodate the installation clamp 66.

INDUSTRIAL APPLICABILITY

Modern furniture construction frequently fails to provide secure storage for large articles such as purses and the like. Such storage for the retrofit market is unknown. The storage drawer in accordance with the invention provides a secure storage that accommodates large articles and not only inhibits tampering and illegal entry, but also provides adequate knee clearance for the user, once the drawer is installed. The storage drawer 20 is designed to provide ample storage space for a variety of articles while avoiding inconvenience to a user seated at a work table or desk to which it is attached.

An installation clamp is provided for the drawer so that the drawer may be retrofitted to installed furniture without disassembling the furniture or clearing materials therefrom. The installation clamp may be used to mount any drawer with suspension brackets of a design in accordance with the invention.

There is therefore provided a new and useful secure storage drawer which fulfills a need not satisfied by existing furniture constructions.

The embodiments of the invention hereinbefore described are intended to be exemplary only. Changes and modification may be made to the described embodiments without departing from the scope of the invention which is intended to be limited solely by the scope of the appended claims.

I claim:

1. A drawer assembly for mounting to a horizontal surface of desk or table, the drawer assembly comprising:

a pair of suspension brackets and a storage drawer;

the pair of suspension brackets for being mounted in a parallel relationship to support the storage drawer, each suspension bracket including a U-shaped channel with a bottom channel wall and parallel channel sidewalls slidably supporting a drawer slide of said storage drawer, one of the channel sidewalls being longer than another of the channel sidewalls, the longer channel sidewall being inturned so that a portion thereof forms a flat flange in a plane above the shorter channel sidewall and parallel with the bottom channel wall of the U-shaped channel, and a free edge of the flat flange extends past a plane coincident with the shorter channel sidewall, the free edge being adapted for receiving fasteners for mounting the suspension bracket to the horizontal surface;

the storage drawer including a rectangular drawer face, a first storage area and a second storage area, said rectangular drawer face, said first storage area, and said second storage area being integrally formed, said first storage area being of a first depth and length such that knee clearance is provided for a person sitting at the desk or table when the storage drawer is installed and is in its closed position;

said first storage area extending rearwardly of the drawer face, and said second storage area extending rearwardly of said first storage area and being of a second depth which is substantially greater than said first depth and of a second length such that the drawer assembly lies within outer edges of the surface of the desk or table when installed, and said storage drawer is slidably supported by the drawer slides which reciprocates in the U-shaped channels, and whereby a total length of the storage drawer being such that fasteners used to mount the suspension brackets are concealed and access to the fasteners is not permitted when the storage drawer is installed and is in its closed position.

2. A drawer assembly as claimed in claim 1, which includes means for locking the storage drawer in its closed position.

3. A drawer assembly as claimed in claim 2, wherein the drawer face includes a metallic core for supporting the means for locking the storage drawer in its closed position.

4. A storage drawer as claimed in claim 3, wherein the means for locking the storage drawer the closed position comprises a key lock having a rotatable lock arm that engages a notch in an adjacent one of the suspension brackets.

5. A drawer assembly as claimed in claim 1, wherein the drawer assembly may be mounted without surrounding cabinetry.

6. A drawer assembly as claimed in claim 1, wherein the first storage area is partitioned into a plurality of compartments of various sizes and shapes.

7. A storage drawer assembly as claimed in claim 1, wherein the drawer face is covered with a resilient material.

8. A storage drawer as claimed in claim 1, wherein the storage drawer is molded from one of an impact resistant thermoset and thermoplastic material.

* * * * *